US008651188B2

(12) United States Patent
Scarsdale et al.

(10) Patent No.: US 8,651,188 B2
(45) Date of Patent: Feb. 18, 2014

(54) GAS LIFT BARRIER VALVE

(75) Inventors: Kevin T. Scarsdale, Pearland, TX (US); Jason Kamphaus, Missouri City, TX (US); Jacob Hahn, Pearland, TX (US); Thomas M. White, Spring, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 823 days.

(21) Appl. No.: 12/650,499

(22) Filed: Dec. 30, 2009

(65) Prior Publication Data

US 2011/0155391 A1 Jun. 30, 2011

(51) Int. Cl.
*E21B 34/00* (2006.01)

(52) U.S. Cl.
USPC ..... 166/332.8; 166/332.1; 137/516.29; 251/332

(58) Field of Classification Search
USPC ..... 166/332.1, 332.8, 551, 353; 277/549, 277/562, 314; 137/516.29, 516.27, 516.25; 251/332, 359
See application file for complete search history.

(56) References Cited

U.S. PATENT DOCUMENTS

| | | | | | |
|---|---|---|---|---|---|
| 2,223,944 | A | * | 12/1940 | Roy | 137/517 |
| 2,485,092 | A | * | 10/1949 | Gannon | 251/332 |
| 2,519,541 | A | * | 8/1950 | Bryant | 251/332 |
| 2,676,782 | A | * | 4/1954 | Bostock et al. | 137/516.29 |
| 3,009,476 | A | * | 11/1961 | Usab | 137/516.29 |
| 3,091,254 | A | * | 5/1963 | Kilayko | 137/516.29 |
| 3,202,178 | A | * | 8/1965 | Wolfe | 137/516.29 |
| 3,226,082 | A | * | 12/1965 | Gulick et al. | 251/367 |
| 3,269,692 | A | * | 8/1966 | Shafer | 251/172 |
| 3,346,008 | A | * | 10/1967 | Scaramucci | 137/516.29 |
| 3,356,333 | A | * | 12/1967 | Scaramucci | 251/172 |
| 3,375,874 | A | * | 4/1968 | Cherry et al. | 166/114 |
| 3,446,475 | A | * | 5/1969 | Scaramucci | 251/156 |
| 3,489,170 | A | * | 1/1970 | Leman | 137/516.29 |
| 4,076,212 | A | * | 2/1978 | Leman | 251/332 |
| 4,248,308 | A | | 2/1981 | Pringle | |
| 4,293,116 | A | * | 10/1981 | Hinrichs | 251/173 |
| 4,356,867 | A | * | 11/1982 | Carmody | 166/373 |
| 4,377,273 | A | * | 3/1983 | Beson | 251/210 |
| 4,444,266 | A | * | 4/1984 | Pringle | 166/324 |
| 4,474,208 | A | * | 10/1984 | Looney | 137/516.29 |
| 4,583,596 | A | * | 4/1986 | Davis | 166/332.8 |
| 4,586,534 | A | * | 5/1986 | McNeely | 137/515.7 |
| 4,618,154 | A | * | 10/1986 | Freudenthal | 277/556 |

(Continued)

FOREIGN PATENT DOCUMENTS

| | | | |
|---|---|---|---|
| AU | 2005225752 | B2 | 10/2005 |
| EP | 1727962 | B1 | 1/2008 |
| WO | 9953170 | A1 | 10/1999 |

*Primary Examiner* — Jennifer H Gay
*Assistant Examiner* — Elizabeth Gitlin
(74) *Attorney, Agent, or Firm* — Jim Patterson

(57) ABSTRACT

A gas lift valve that has a longitudinally extending tubular body having an inlet and an outlet, a flow path extending between the inlet and the outlet, and a flow tube located inside the body. The flow tube is translatable in the axial direction between at least a first and a second position. A venturi orifice located inside the body along the flow path. A seal part is located proximate to the outlet of the body. A flapper is connected with the body by way of a hinge part and the flapper has at least a first open position and a second closed position. The closed position is where the flapper contacts the seal thereby closing the flowpath and the second closed position is where the flapper does not contact the seal and does not close the flowpath.

17 Claims, 7 Drawing Sheets

(56) References Cited

U.S. PATENT DOCUMENTS

| | | | | | |
|---|---|---|---|---|---|
| 4,674,575 | A | * | 6/1987 | Guess | 166/332.8 |
| 4,703,805 | A | * | 11/1987 | Morris | 166/324 |
| 4,781,213 | A | * | 11/1988 | Kilayko | 137/516.29 |
| 4,815,770 | A | * | 3/1989 | Hyne et al. | 285/123.12 |
| 4,834,183 | A | * | 5/1989 | Vinzant et al. | 166/321 |
| 4,862,965 | A | * | 9/1989 | Pringle | 166/380 |
| 4,911,408 | A | * | 3/1990 | Kemp | 251/174 |
| 4,926,945 | A | * | 5/1990 | Pringle et al. | 166/321 |
| 5,004,007 | A | * | 4/1991 | Johnson et al. | 137/501 |
| 5,125,457 | A | * | 6/1992 | Meaders | 166/322 |
| 5,201,371 | A | * | 4/1993 | Allen | 166/325 |
| 5,249,600 | A | * | 10/1993 | Blume | 137/516.29 |
| 5,257,663 | A | | 11/1993 | Pringle et al. | |
| 5,263,847 | A | * | 11/1993 | Akkerman et al. | 251/303 |
| 5,323,859 | A | * | 6/1994 | Smith et al. | 166/321 |
| 5,503,229 | A | * | 4/1996 | Hill et al. | 166/324 |
| 5,522,418 | A | | 6/1996 | Johnson et al. | |
| 5,752,569 | A | * | 5/1998 | Bhavsar et al. | 166/324 |
| 5,884,705 | A | * | 3/1999 | Hill, Jr. | 166/324 |
| 5,918,858 | A | * | 7/1999 | Rawson et al. | 251/359 |
| 5,996,687 | A | * | 12/1999 | Pringle et al. | 166/66.6 |
| 6,079,497 | A | * | 6/2000 | Johnston et al. | 166/324 |
| 6,209,663 | B1 | * | 4/2001 | Hosie | 175/57 |
| 6,296,061 | B1 | * | 10/2001 | Leismer | 166/386 |
| 6,394,187 | B1 | * | 5/2002 | Dickson et al. | 166/383 |
| 6,425,413 | B2 | * | 7/2002 | Davis et al. | 137/527 |
| 6,651,693 | B2 | * | 11/2003 | Simmons et al. | 137/329.05 |
| 6,698,719 | B2 | * | 3/2004 | Geiser | 251/332 |
| 6,854,519 | B2 | * | 2/2005 | Deaton et al. | 166/374 |
| 7,152,688 | B2 | * | 12/2006 | Richards | 166/386 |
| 7,360,600 | B2 | * | 4/2008 | MacDougall et al. | 166/332.8 |
| 7,360,602 | B2 | * | 4/2008 | Kritzler et al. | 166/372 |
| 7,464,763 | B2 | * | 12/2008 | Galloway et al. | 166/372 |
| 7,600,534 | B2 | * | 10/2009 | Deaton | 137/527 |
| 7,841,416 | B2 | * | 11/2010 | Henschel et al. | 166/386 |
| 7,967,076 | B2 | * | 6/2011 | Kim et al. | 166/386 |
| 2003/0024571 | A1 | * | 2/2003 | Simmons et al. | 137/329.05 |
| 2004/0154803 | A1 | | 8/2004 | Anderson et al. | |
| 2006/0169465 | A1 | * | 8/2006 | Hejl et al. | 166/386 |
| 2007/0137869 | A1 | * | 6/2007 | MacDougall et al. | 166/386 |
| 2007/0181312 | A1 | | 8/2007 | Kritzler et al. | |
| 2008/0047713 | A1 | * | 2/2008 | Henschel et al. | 166/321 |
| 2008/0121397 | A1 | | 5/2008 | Galloway et al. | |
| 2008/0142752 | A1 | * | 6/2008 | Matzner | 251/314 |
| 2009/0044947 | A1 | * | 2/2009 | White et al. | 166/321 |
| 2011/0088908 | A1 | * | 4/2011 | Xu | 166/332.8 |

* cited by examiner

GAS LIFT BARRIER VALVE

TECHNICAL FIELD

The present application relates to devices for injecting lift gas into a production conduit of an oil well via one or more gas lift flow control devices and to a gas lift flow control device for use in the method.

BACKGROUND

Lift gas can be pumped into an annulus between a production tubing and surrounding well casing and subsequently into the production tubing from the annulus via one or more one way gas lift flow control devices in side pockets that are distributed along the length of the production tubing. The lift gas which is injected through the flow control devices into the crude oil (or other fluid) stream in the production conduit reduces the density of the fluid column in the production conduit and enhances the crude oil production rate of the well.

Gas lift flow control devices can use one way check valves which comprise a flapper type valve that presses against a seating. They can also include a ball or hemisphere or cone which is pressed against a valve seating ring by a spring. If the lift gas pressure is higher than the pressure of the crude oil stream in the production conduit then this pressure difference exceeds the forces exerted to the check valve by the spring so that the spring is compressed and the valve is opened and lift gas is permitted to flow from the gas filled injection conduit into the production conduit. If however the pressure of the crude oil stream is higher than the lift gas pressure in the injection conduit, the accumulated forces of the spring and the pressure difference across the gas lift flow control device closes the check valve and prevents crude oil, or other fluid, to flow from the production conduit into the injection conduit.

Issues exist relating to integrity of the sealing function of the one way valve, particularly across a wide range of pressure differentials, e.g., zero to high pressure differential. Also, issues exist with degradation of the seals through exposure to flow of gas and well fluids for various reasons, e.g., debris in the flow.

Accordingly, it is desirable to improve the sealing of the one way valve, and also to protect the integrity of the sealing components during flow of the gas and operation in general.

SUMMARY

A preferred embodiment includes a gas lift valve that has a longitudinally extending tubular body having an inlet and an outlet, a flow path extending between the inlet and the outlet, and a flow tube located inside the body. The flow tube is translatable in the axial direction between at least a first and a second position. A venturi orifice is located inside the body along the flow path. A seal part is located proximate to the outlet of the body. A flapper is connected with the body by way of a hinge part and the flapper has at least a first open position and a second closed position. The closed position is where the flapper contacts the seal thereby closing the flowpath and the second closed position is where the flapper does not contact the seal and does not close the flowpath.

BRIEF DESCRIPTION OF THE DRAWINGS

The following is a brief description of figures herein showing some preferred embodiments of various designs.

DETAILED DESCRIPTION

In the following description, numerous details are set forth to provide an understanding of the present embodiments. However, it will be understood by those skilled in the art that the present embodiments may be practiced without many of these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Figure 1:
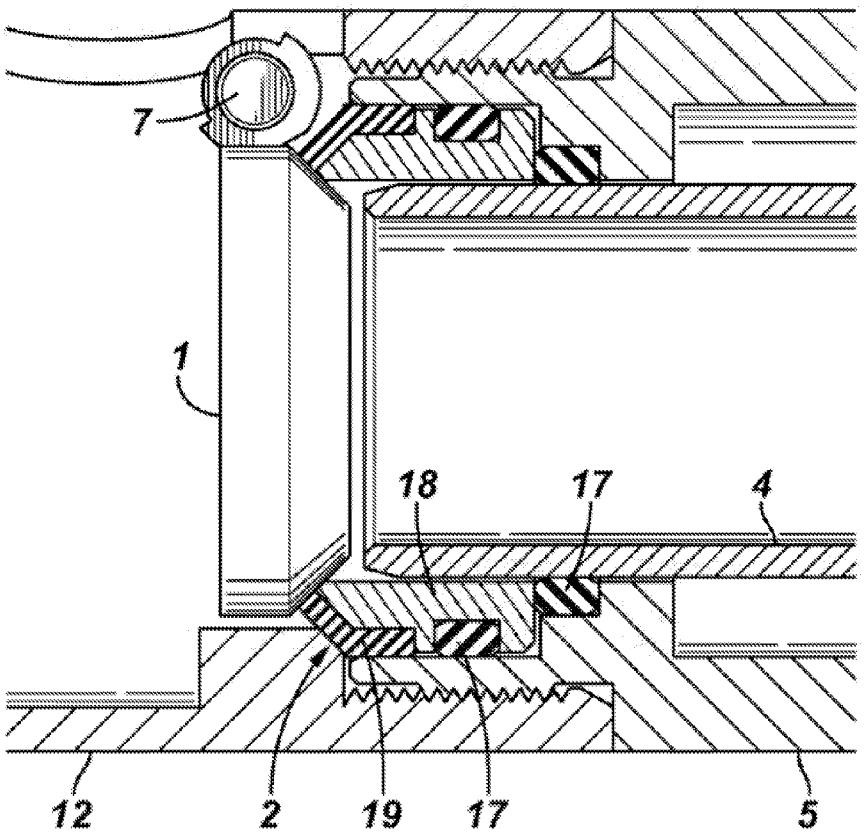
FIG. 1 shows a side section view of an embodiment.

FIG. 1 shows a side view of various features. A gas lift valve has a body 5 that contains and supports various parts of the device. A flow tube 4 is located inside the body 5. The body 5 can be a generally tubular shape. The flow tube 4 is a hollow tubular shape and can be translatable along an axial direction within the body 5. A flapper valve 1 is connected with the body 5 by way of a hinge part 7. The flapper valve 1 seals an opening leading into a portion of the body 5 that houses the flow tube 4. The flow tube 4 is translatable and has at least two distinct positions. In one position the flow tube 4 is retracted and does not extend though the opening defined by a seal part 2. In another position, the flow tube 4 extends though the opening defined by the seal part 2. The seal part 2 and the flapper 1 contact one another and together close the opening defined by the seal part 2. In other words, the flapper 1 seats itself with the seal part 2 thereby closing the opening. This configuration is effectively a one way valve as flow cannot occur is a direction into the flow tube 4. The hinge part 7 connected with the flapper 1 can include a spring that biases the flapper 1 into the closed position covering the opening defined by the seal part 2.

A purpose of the flow tube 4 is to protect the seal part 2. According to embodiments, when in use the gas lift valve is located in a conduit connecting a well annulus with an internal production tube. The gas lift valve is located in a side pocket of the production tubing that connects the annulus with the interior of the production tubing. Gas is forced into the annulus and when a proper pressure is reached, the gas travels from the annulus, through the gas lift valve, and into the production tubing. As is apparent from FIG. 1, the gas travels through the flow tube 4, out the opening defined by the seal 2, and into the annulus. Accordingly, as the flow tube 4 is extended when the flow occurs, any debris in the flow is shielded from the seal part 2, thereby maintaining the integrity of the seal part 2 and allowing for a longer life.

The seal part 2 can be made up of a hard metal portion 18 and at least one softer spring or elastomeric portion 19. Additionally, the seal part 2 can have a self-aligning feature. In FIG. 1, elastic elements 17 contact and support the hard metal portion 18 to help align the hard metal portion 18 with the flapper 1 when the flapper 1 is in the closed position as shown in FIG. 1.

Figure 2:
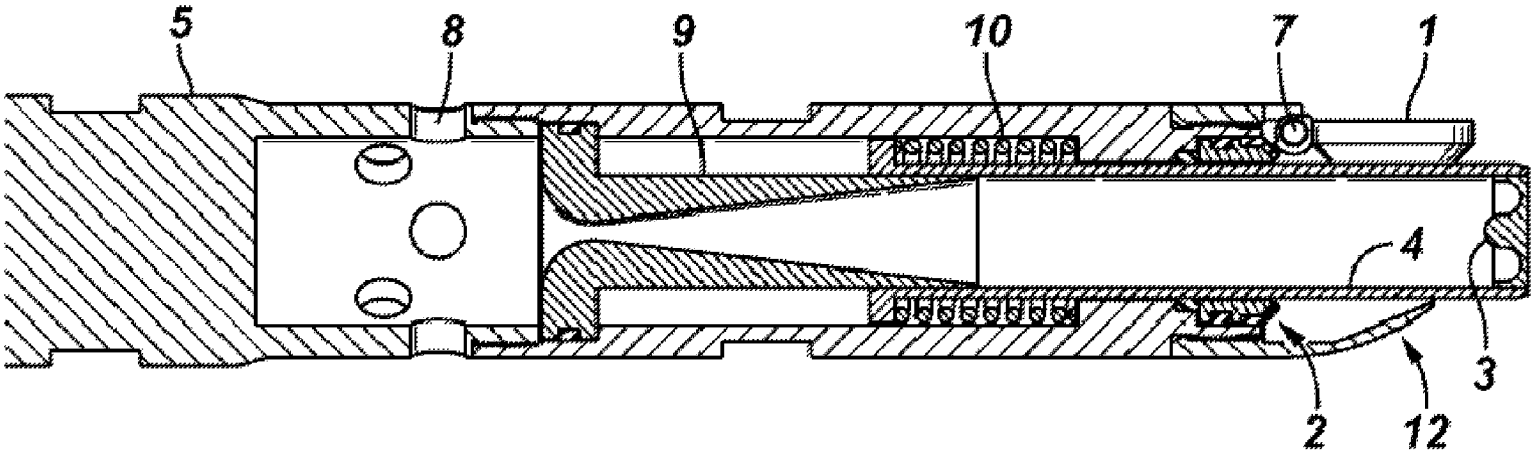
FIG. 2 shows a side section view of an embodiment.

FIG. 2 shows an embodiment and includes a venturi style restriction 9. The body 5 has passages 8 where the gas from the annulus enters the body 5. The flow tube 4 and the body 5 are connected by way of a spring 10 that biases the flow tube 4 into the retracted position. Also, the flapper 1 can be biased toward the closed position. Accordingly, there is a need to force the flow tube into the extended position upon application of the gas in the annulus. According to the present application, there are a number of embodiments that accomplish that goal.

In FIG. 2, a blunt body 3 is located at the end of the flow tube 4. The blunt body 3 is in the flow path and thereby forces the flow tube 4 into the extended position during flow of the gas. The blunt body 3 can be any part that impinges the flow and transfers force from the flow to the flow tube 4. The extension of the flow tube 4 and the gas opens the flapper 1. As the flow tube 4 extends during flow of the gas the seal part 2 is protected.

Figure 3:
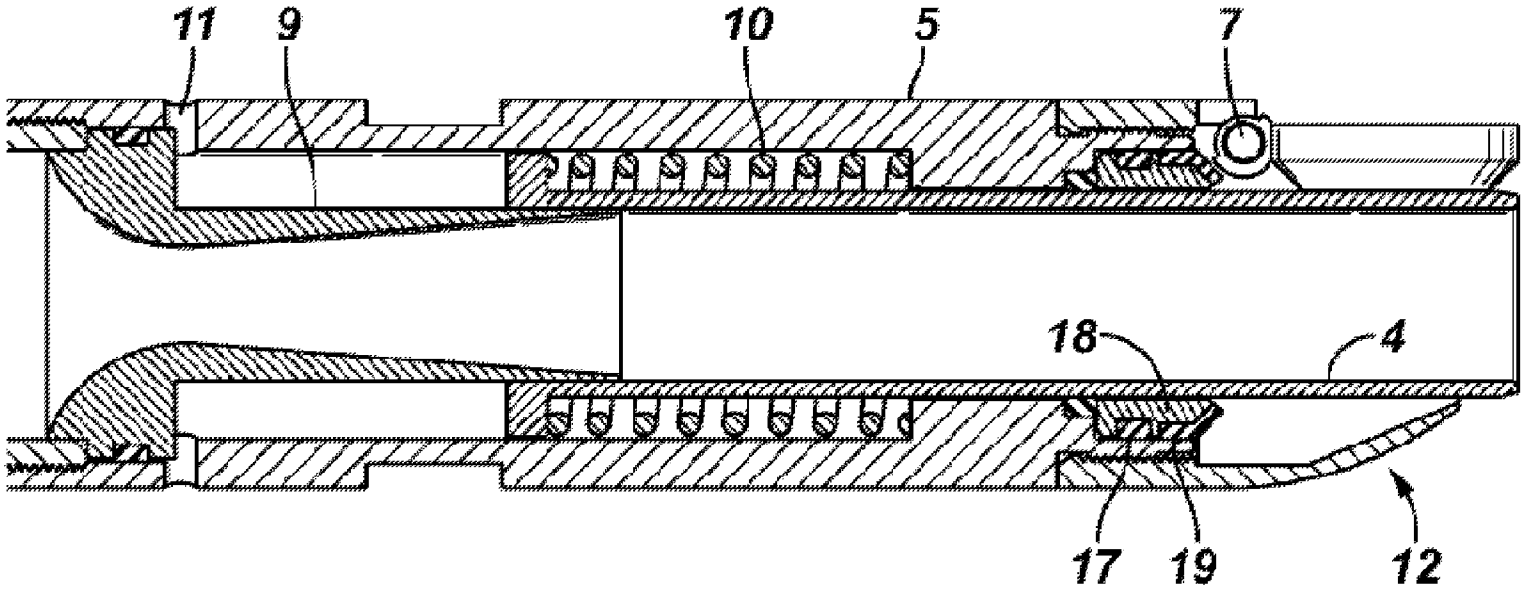
FIG. 3 shows a side section view of an embodiment.
Figure 4:
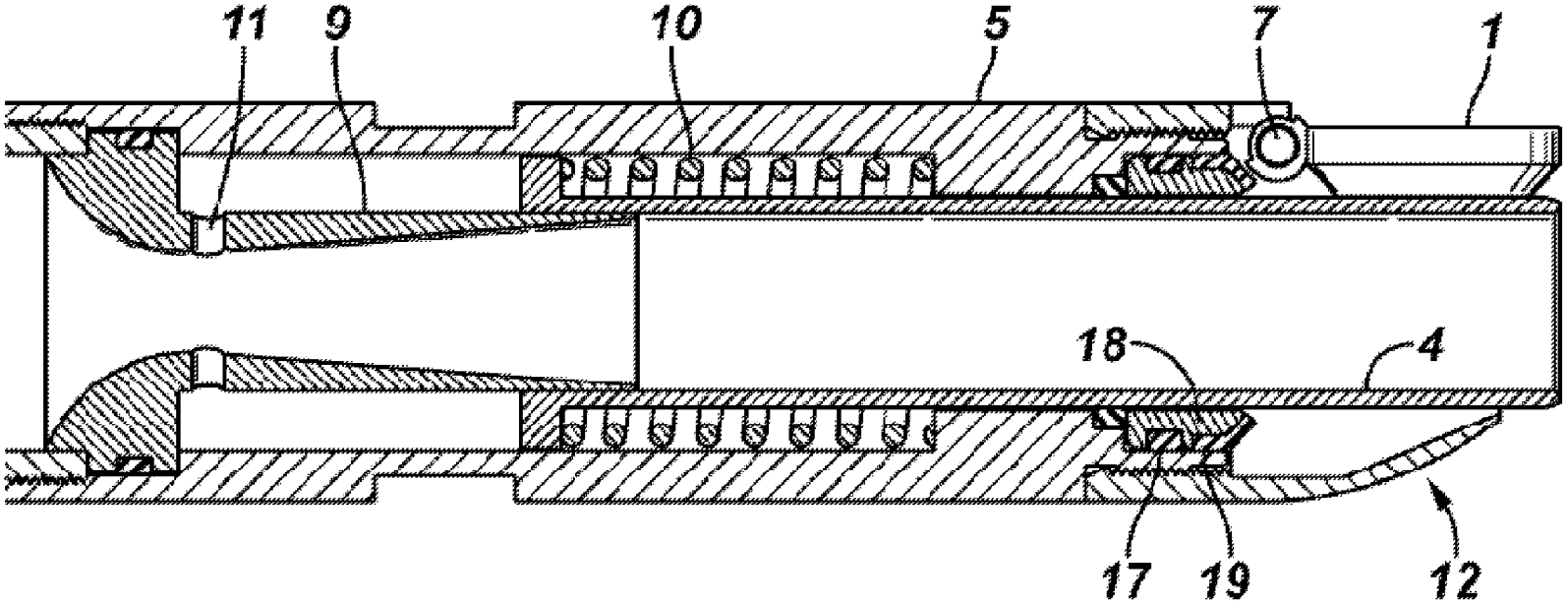
FIG. 4 shows a side section view of an embodiment.

FIG. 3 shows embodied features according to the present application. A pressure tap 11 connects the outside of the body 5 in the annulus with a passage that is adjacent to and connects with the flow tube 4. Upon application of pressure in the pressure tap 11, the flow tube 4 is forced into an extended position through the opening defined by the seal 2, thereby protecting the seal 2 during flow of the gas. Also, the flapper 1 is forced open.

Figure 5:
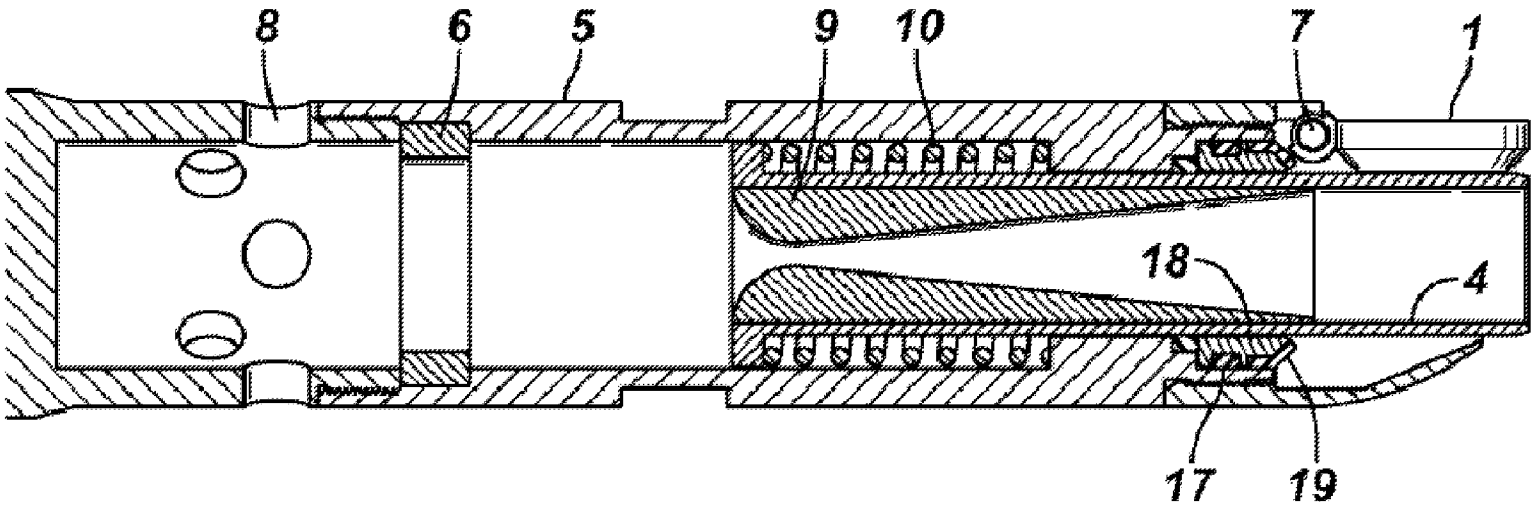
FIG. 5 shows a side section view of an embodiment.

FIG. 5 shows an embodiment where the venturi flow restrictor 9 is connected with the flow tube 4. As gas flows through the venturi 9, force is created by way of the pressure drop across the venturi that forces the flow tube 4 into an extended position. FIG. 5 shows the flow tube 4 in an extended position through the opening defined by the seal 2 where the flapper 1 is open.

Figure 6:
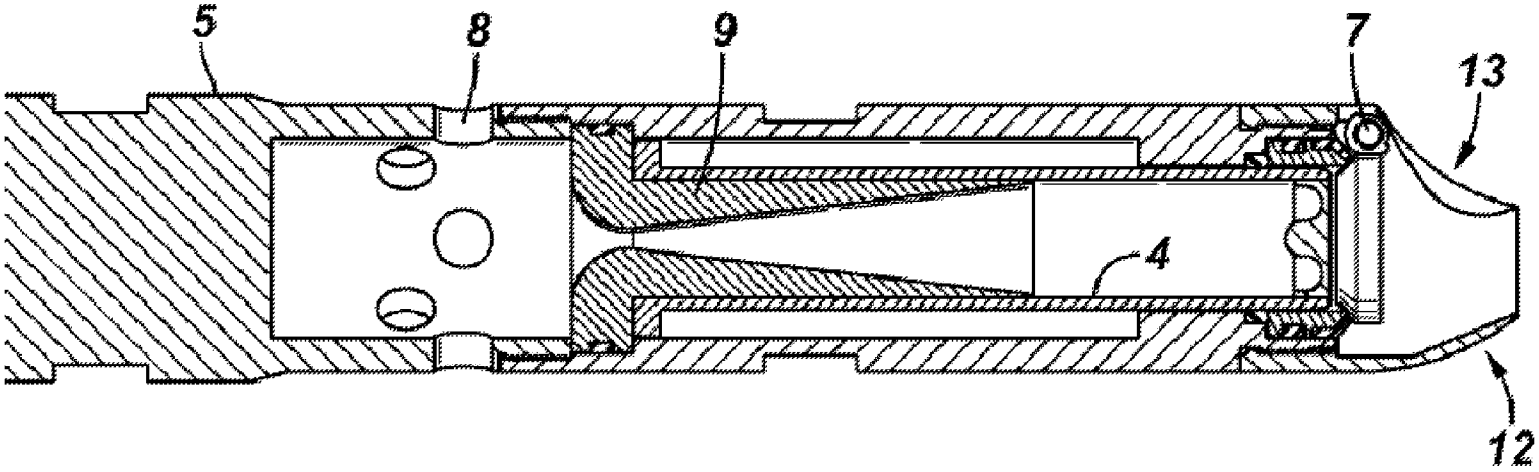
FIG. 6 shows a side section view of an embodiment.

FIG. 6 shows an embodiment including a nose profile 12 that is connected with the body 5. The nose profile 12 helps deploy and locate the gas lift valve in a pocket of the production tubing. The nose profile 12 is generally a contoured or pointed part in that regard. A hole can be present in nose profile 12 so that the flapper can fully open. Absent the hole, the flapper 1 would likely contact the nose profile 12 and not open fully. An aspect of the present application is the nose profile 12 being made from a degradable material that will dissolve relatively quickly in a well environment. If the nose profile 12 dissolves quickly enough, there is no need for a hole to accommodate the opening of the flapper 12.

Figure 7:
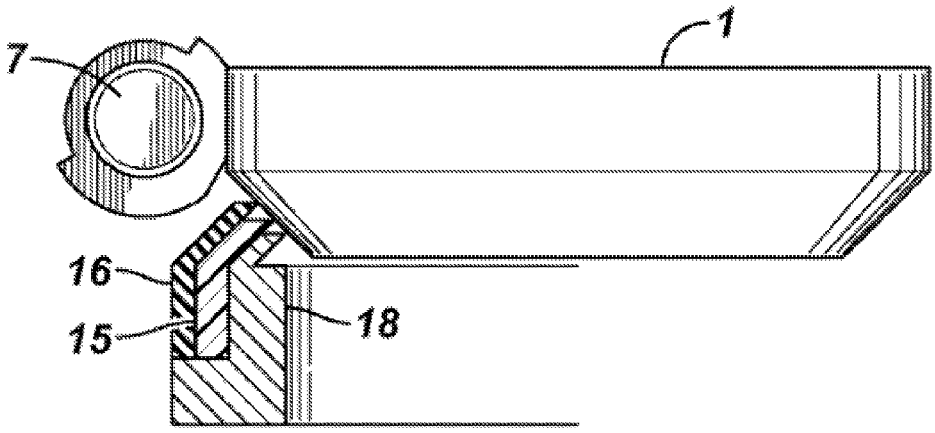
FIG. 7 shows a side section view of an embodiment.

FIG. 7 is a close up view of an embodiment of the seal part 2. According to this embodiment, the seal part 2 has three components. The first component is a hard seat 18 made from metal. Under high pressure differential the metal seat 18 will contact the flapper 1 and form a seal. The second component is a polytetrafluoroethylene (PTFE) or polyetheretherketone (PEEK) seat 15. Under a pressure lower than the high pressure, the PTFE or PEEK seat 15 will form the primary seal. The third component is an elastomeric seat 16. The elastomeric seat 16 forms the primary seat when lower or no pressure differential is experienced. In other words, as the pressure differential increases, the various seats are compressed to different degrees and as the pressure gets higher, different components form the primary seal.

The embodiments described herein are merely examples of various preferred designs and are not meant in any way to unduly limit the scope of any presently recited or subsequently related claims.

What is claimed is:

1. A gas lift valve, comprising:

a longitudinally extending tubular body having an inlet and an outlet, a flow path extending between the inlet and the outlet;

a flow tube located inside the body, the flow tube being translatable in the axial direction between at least a first and a second position wherein the flow tube comprises a first end, a second end and a blunt body located at the second end;

a venturi flow restrictor that comprises a venturi orifice, the venturi flow restrictor located inside the body along the flow path and disposed at least partially within the flow tube via an opening of the first end of the flow tube;

a seal part located proximate to the outlet of the body;

a flapper connected with the body by way of a hinge part, the flapper having at least a first position being an open position and a second position being a closed position, the closed position being where the flapper contacts the seal part thereby closing the flow path and the open position being where the flapper does not contact the seal part and does not close the flow path, a transition from the closed position to the open position occurring in response to flow in the flow path impinging the blunt body to transfer force to the flow tube to contact the flapper and to force the flapper to the open position wherein where the flow tube is in its second position, the second end, the blunt body and a portion of the flow tube extends through an opening defined by the seal part, the portion shielding the seal part from flow along the flow path.

2. The gas lift valve of claim 1, wherein the seal part comprises at least three distinct components that comprise a first component that comprises a hard metal seat;

a second component, concentric to the first component, that comprises a seat that comprises polytetrafluoroethylene (PTFE) or polyetheretherketone (PEEK); and a third component, concentric to the second component, that comprises an elastomeric seat.

3. The gas lift valve of claim 2, wherein at a first pressure differential across the flapper, the elastomeric seat forms a primary seal;

at a second pressure differential across the flapper that is larger than the first pressure differential, the elastomeric seat is fully compressed and the PTFE or PEEK seat forms a primary seal; and at a third pressure differential across the flapper that is higher than both the first pressure differential and the second pressure differential, both the elastomeric seat and the PTFE or PEEK seat are compressed so that the hard metal seat contacts the flapper thereby forming a primary seal.

4. The gas lift valve of claim 3, wherein the elastomeric seat extends a distance, the PTFE or PEEK seat extends a distance less than the elastomeric seat, and the hard metal seat extends a distance less than either the elastomeric seat or the PTFE or PEEK seat.

5. The gas lift valve of claim 3, wherein the first pressure differential is zero.

6. The gas lift valve of claim 1, wherein a spring is located between the flow tube and the body, the spring exerting a force on the flow tube thereby biasing the flow tube into its first position.

7. The gas lift valve of claim 6, comprising a pressure conduit from outside the gas lift valve to a pressure chamber inside the body and adjacent to the flow tube, whereby increased pressure in the pressure chamber biases the flow tube toward its second position against the biasing force of the spring.

8. The gas lift valve of claim 6, wherein a pressure conduit extends through the venturi orifice.

9. The gas lift valve of claim 1, wherein the gas lift valve is adapted to fit into a side pocket mandrel in production tubing of a subterranean hydrocarbon well.

10. The gas lift valve of claim 1, wherein the hinge part has a spring element that biases the flapper toward a closed position.

11. The gas lift valve of claim 1, wherein at least one elastic element is located between the seal part and the body to provide elastic deformation responsive to force applied to the seal part by the flapper part in the closed position.

12. The gas lift valve of claim 1 wherein the seal part comprises at least three distinct components that comprise a hard metal component, a softer elastomeric component, and one or more elastic element components that contact and support the hard metal component to help align the hard metal component when the flapper is in the closed position.

13. The gas lift valve of claim 12 wherein the one or more elastic element components comprise O-rings.

14. The gas lift valve of claim 12 wherein the flapper contacts the softer elastomeric component when the flapper is in the closed position at a first pressure differential across the flapper and wherein the flapper contacts the hard metal component when the flapper is in the closed position at a second pressure differential across the flapper that exceeds the first pressure differential across the flapper.

15. A method of sealing a one way gas lift flapper valve seal, comprising:

locating a gas lift valve downhole in a side pocket mandrel of a production tube of a subterranean hydrocarbon well, the gas lift valve comprising a longitudinally extending tubular body having an inlet and an outlet, a flow path extending between the inlet and the outlet;

a flow tube located inside the body, the flow tube being translatable in the axial direction between at least a first and a second position wherein the flow tube comprises a first end, a second end and a blunt body located at the second end;

a venturi flow restrictor that comprises a venturi orifice, the venturi flow restrictor located inside the body along the flow path and disposed at least partially within the flow tube via an opening of the first end of the flow tube;

a seal part located proximate to the outlet of the body; and a flapper connected with the body by way of a hinge part, the flapper having at least a first position being an open position and a second position being a closed position, the closed position being where the flapper contacts the seal part thereby closing the flow path and the open position being where the flapper does not contact the seal part and does not close the flow path, a transition from the closed position to the open position occurring in response to flow in the flow path impinging the blunt body to transfer force to the flow tube to contact the flapper and to force the flapper to the open position wherein where the flow tube is in its second position, the second end, the blunt body and a portion of the flow tube extends through an opening defined by the seal part, the portion shielding the seal part from flow along the flow path.

16. The method of claim 15, wherein a pressure differential is applied across the flapper in the closed position.

17. The method of claim 15 wherein the seal part comprising at least three distinct components that comprise a first component being a hard metal seat, a second component, concentric to the first component, being a seat that comprises polytetrafluoroethylene (PTFE) or polyetheretherketone (PEEK), and a third component, concentric to the second component, being an elastomeric seat.

* * * * *